US006110591A

United States Patent [19]

Crosier

[11] Patent Number: 6,110,591

[45] Date of Patent: Aug. 29, 2000

[54] COMPRESSED HIGH TEMPERATURE NON-ASBESTOS SHEET AND METHOD FOR MAKING THE SAME

[75] Inventor: Robert A. Crosier, Mooresville, N.C.

[73] Assignee: Slade Group, LLC, Mooresville, N.C.

[21] Appl. No.: 09/065,656

[22] Filed: Apr. 23, 1998

Related U.S. Application Data

[60] Provisional application No. 60/043,972, Apr. 23, 1997.

[51] Int. Cl.[7] ..... C11D 3/00

[52] U.S. Cl. ..... 428/368; 428/59; 428/225; 428/364; 428/373; 428/374; 428/376; 428/377

[58] Field of Search ..... 428/59, 225, 364, 428/373, 374, 376, 377, 368, 2

[56] References Cited

U.S. PATENT DOCUMENTS 5,683,778 11/1997 Crosier ..... 428/59

*Primary Examiner*—Richard Weisberger
*Attorney, Agent, or Firm*—Dougherty & Associates

[57] ABSTRACT

A high temperature non-asbestos compressed sheet formed without rubber binders, additives, curatives and fillers. The yarns that comprise the invented woven compressed sheet have an elongated metallic core and a vermiculated graphite jacket substantially encapsulating the jacket. In one preferred embodiment, the core is either a metallic foil or a flattened metallic wire both having a generally rectangular cross-section. In another preferred embodiment, the core is a metallic wire shrouded by carbon fibers. The yarns also include an adhesive layer that secures the jacket to the core. Also disclosed is a method for making the invented sheet.

10 Claims, 4 Drawing Sheets

COMPRESSED HIGH TEMPERATURE NON-ASBESTOS SHEET AND METHOD FOR MAKING THE SAME

CROSS-REFERENCE TO RELATED APPLICATIONS

This application claims the benefit of U.S. Provisional application Ser. No. 60/043,972 filed Apr. 23, 1997.

FIELD OF THE INVENTION

This invention relates generally to non-asbestos compressed sheets formed without rubber binders, additives, curatives and fillers and to a method for making the same. More particularly, the invention relates to a non-asbestos compressed sheet composed of strands having a metallic core encased in a vermiculated graphite jacket.

BACKGROUND

Those skilled in the art of manufacturing and designing industrial gaskets have historically been skilled in the manufacturing practice of compressing asbestos fiber sheets that are later cut and shaped into industrial gaskets. Typically, compressed asbestos sheets are formed by adding a rubber binder to a base of asbestos fibers. A two roller sheeter machine then converts the resultant mixture into sheet form. Finally, the resultant mixture is exposed to high pressure and temperature.

Initially, compressed sheets made from asbestos were standard for forming gaskets due to the superior temperature properties of asbestos. Despite the utility of compressed asbestos sheets, their use has been severely curtailed, especially in environments where there is a potential for human ingestion of asbestos, since it was discovered that asbestos can cause serious health problems.

As a result, numerous attempts have been made to manufacture compressed sheets for gasketing applications without using asbestos. However, none of these alternative industrial fibers have been able to withstand the high temperatures that asbestos gaskets can.

Obviously, the goal has been to manufacture a compressed non-asbestos sheet that retains the properties of the compressed asbestos sheets they replaced. Typically, these replacements for asbestos sheets have randomly distributed fibers bonded together with as much as twenty-five (25) percent of a rubber elastomer which cannot withstand temperatures above 500° Fahrenheit. For example, U.S. Pat. No. 4,859,526 to Potepan et al. discloses a compressed non-asbestos sheet made with a fiber base composed of carbon fibers mixed with a small proportion of organic fibers such as aramid fibers. The carbon fibers have a degree of carbonization greater than ninety (90) percent and a modulus of elasticity below 10,000,000 psi. An elastomeric material is used to bind the carbon fibers and organic fibers. These rubber bonded sheets include organic fibers, rubber binders, fillers and curatives in their composition.

Because existing non-asbestos compressed sheets, such as those described in Potepan, are typically bonded with an elastomeric rubber material, gaskets formed from such sheets cannot withstand high operating temperatures. Elastomeric rubber materials typically have operating temperature limits ranging from 250° Fahrenheit to 450° Fahrenheit. Similarly, the aramid fibers used to form such sheets have an upper temperature limit of 550° Fahrenheit. Thus, the elastomeric rubber materials and aramid fibers have temperature limitations well below the typical temperatures which compressed sheet gaskets made from such sheeting are frequently exposed to. Despite these limitations, gaskets composed of existing non-asbestos compressed sheets containing such elements are operated at temperatures well above the individual temperature limits of the materials because those materials carbonize without excessive loss of volume. However, when this happens, the gaskets lose their resiliency and strength.

As previously discussed, existing non-asbestos sheets often contain in excess of twenty (20) percent rubber used as a binder. Because rubber tends to oxidize into a powder between hot flanges, the rubber will lose its cohesion properties, thereby making existing non-asbestos compressed sheets unsuitable for use at high temperatures.

Another problem with existing non-asbestos compressed sheets is that the properties of the sheeting diminish significantly during storage. Typically, this sheeting shelf-cures during storage causing the sheeting to harden or age. After only a relatively short period of time, the sheeting becomes, for all practical purposes, unusable.

Existing compressed sheets are not suitable for many industrial applications, such as gasketing in nuclear power plant reactor coolant systems. The curatives, fillers, additives and sulfur based compounds used to manufacture existing compressed sheets may be released in the presence of treated reactor coolant to form corrosive chemical contaminants. Those chemical contaminants leach in to the treated coolant and can attack vital metal parts possibly resulting in dire consequences.

Finally, the process for making existing non-asbestos compressed sheets also involves the use of solvents. The use of solvents poses a substantial health risk to the people manufacturing the compressed sheets. Further, the use of solvents requires expensive solvent recovery systems that significantly increase the manufacturing cost of the compressed sheets.

Consequently, gaskets made from compressed non-asbestos sheets, such as those made in accordance with Potepan, have relatively low high temperature limits, shorter life spans, and require more maintenance than the asbestos gaskets they replaced. Compressed sheet gaskets made from other asbestos substitutes suffer from similar deficiencies.

A need, therefore, exists for a non-asbestos compressed sheet A that can be manufactured into a gasket which can perform as well as or better than gaskets made from asbestos sheeting without the health consequences incident to asbestos.

Gaskets made from existing non-asbestos compressed sheets are solid in nature and tend to break when bent or folded. A need, therefore, also exists for a non-asbestos compressed sheet that has excellent workability and at the same time retain its integrity.

While cables of braided graphite fiber theoretically have been known for years, their incorporation into compressed sheets has been largely unsuccessful because of the elusiveness of effective reinforcement of vermiculated natural flake graphite. An effective method of joining a ribbon of graphite foil to reinforcing strands while still maintaining its extreme service temperature capability has not been possible until now. Consequently, until now, it was not possible to create gasketing sheets made from metallic and carbon fiber reinforced graphite yarns that can withstand service temperatures ranging from about negative 400° Fahrenheit to about 5400° Fahrenheit.

A significant improvement in non-asbestos sheets is disclosed in U.S. Pat. No. 5,683,778 to Crosier which discloses a fiber reinforced composite strand having a reinforcing fiber core, an adhesive a vermiculated graphite jacket. While having much utility, the disclosed strand has insufficient shear resistance for many gasketing applications requiring flattened sheets.

SUMMARY OF THE INVENTION

The present invention is a non-asbestos compressed sheet of woven or braided strands. The strands have a core made from a reinforcing metallic material which is encapsulated in a vermiculated graphite jacket. Preferably, the core is INCONEL™ nickel alloy or stainless steel. However, any other metal having sufficient tensile strength and specific chemical or temperature resistant properties suitable for reinforcement, quartz fiber, stainless steel fiber or carbon/graphite fiber can be substituted.

Preferably, the jacket is made from either an expanded graphite flake or a graphite foil having suitable tensile strength, flexibility and toughness. Encapsulating the metallic core in a vermiculated jacket of graphite obviates the need for rubber binders, additives, curatives and fillers, some of which carbonize in the absence of oxygen at elevated temperatures. The absence of rubber binders, additives, curatives and fillers has no effect on the overall integrity of the yarns because the vermiculated graphite jacket attains the beneficial properties of the rubber binding without its drawbacks.

Thus, sheets made from the invented yarns can be used to seal 4500 psi steam at temperatures in excess of 1200° Fahrenheit. In contrast, existing compressed sheets utilizing rubber binders, additives, curatives and fillers have upper operating limits for sealing steam below 2000 psi and at temperatures below 700° Fahrenheit. Furthermore, those sheets can be formed into products, such as gaskets, that can be exposed to very harsh chemicals, such as solvents, liquid petroleum gases, hydrogen gas and virtually all volatile organic chemicals at most common temperatures and concentrations.

The vermiculated graphite jacketed cores are preferably wire, flattened wire or foil forms that combine high tensile strength and high corrosion resistance and that operate at temperatures up to 1800° Fahrenheit. The invented non-asbestos sheets thereby provide long service life and low maintenance costs.

In one preferred embodiment, the core is a metallic foil or a flattened metallic wire. Example of suitable metallic foils are INCONEL™ (alloy #600) foil and stainless steel foil. Examples of suitable flattened metallic wires are INCONEL™ (alloy #600) wire and stainless steel wire which are flattened between rollers.

With either the metallic foil or the flattened metallic wire, the core has a substantially rectangular cross-section. Preferably, the core has a thickness of between 0.001 and 0.005 inches and a width of between 0.005 and 0.2 inches. It has been found that a core having a thickness of 0.003 inches and a width of 0.06 inches is particularly suitable.

A suitable adhesive coating can also be provided to secure the jacket to the metallic core. Even though the adhesive coating carbonizes at high operating temperatures, the yarns suffer no significant weight or volume loss effect and the sheeting composed from such yarn remain suitable for the services intended. If desired, the adhesive coating may be removed from the yarn by a process of baking the yarn is an industrial oven or a vacuum oven.

In another preferred embodiment, the core is a metallic wire. Examples of suitable metallic wire include INCONEL™ (alloy #600) wire and stainless steel wire. In an alternative embodiment, the core is a quartz fiber, stainless steel fiber, carbon fiber or graphite fiber.

A plurality of carbon fibers substantially shroud the metallic wire core. The jacket surrounds both the metallic wire core and the plurality of carbon fibers. The carbon fibers shrouding the wire core prevent the wire core from cutting through the graphite jacket. This yarn is also suitable for braiding to form a high temperature-high pressure valve packing.

The metallic wire core has either a circular or an oval shaped cross-section. Preferably, the diameter of the metallic wire core is between 0.002 and 0.01 inches. It has been found that a diameter of between 0.004 and 0.005 inches is particularly suitable.

As discussed above, a suitable adhesive coating may be used to secure the jacket to the plurality of carbon fibers shrouding the metallic wire core. Preferably, the adhesive coating initially substantially encapsulates the plurality of carbon fibers and the metallic wire core. A plastic film may be used in conjunction with the adhesive coating. A polyester film having a thickness of 0.00025 inches has been found to be particularly suitable.

Unlike gaskets cut from existing non-asbestos compressed sheets, gaskets made from the invented sheets are virtually creep-free in service even under large stress loads. The high tensile metallic core keeps the jacket in place which prevents drift, a condition that plagues existing non-asbestos compressed sheets. Because of this characteristic, the invented sheets have superior torque retention properties.

Existing compressed sheets formed with rubber binders, additives, curatives and fillers tend to oxidize at relatively low temperatures. Oxidation occurs when unbonded carbon atoms are exposed to sufficiently high temperatures causing carbon-oxygen bonds to form. The vermiculated graphite jacket minimizes the exposure of unbonded carbon atoms to oxygen thereby inhibiting oxidation.

In a preferred embodiment, the strands used to weave the invented sheets may be treated with an anti-oxidant which enables the strands to be used in applications involving higher temperatures than other graphite foil products. This treatment prevents oxidation of the sheets even at extremely high temperatures such as those experienced during use in a gas furnace.

The present invention is useful for a large variety of applications. For example, the strands can also be used to form a soft, compliant, flexible, self-forming rope-like joint sealant. Endless ring gaskets having an uniform thickness can be formed in place with no waste by simply over-lapping or criss-crossing the ends of a piece of a strand. For example, a 0.3125 inch diameter strand will compress to form a 0.75 inch wide endless gasket 0.09 inch thick when used as a valve or joint sealant. The strands can be used in valves that are subjected to pressures in excess of 4500 psi/310 bar and to temperatures between absolute zero and 1800° Fahrenheit/1000° Centigrade and higher.

Because of the aforementioned properties, the invented sheets can be used in applications in which they are exposed to compounds having a pH from 0 to 14, steam, solvents, liquefied petroleum gases, hydrogen gas, virtually all volatile organic compounds and virtually all chemicals at most common temperatures and concentrations.

The present invention is also directed to a method of making a composite yarn, without using rubber binders, additives, curatives and fillers, useful in the manufacture of non-asbestos gasketing cloth. In a preferred embodiment, the strands are a simple, inexpensive yarn made by slitting a roll of expanded graphite flake foil sheet into ribbons having suitable widths for their ultimate purpose. The ribbon is fed into a "protrusion" device which is a combination extrusion/pultrusion die.

A plastic film can then be added to the graphite ribbon. For example, the graphite ribbon is fed through a compression roller with a ribbon of two-sided, adhesive, thin plastic film. One side of the ribbon is bonded to the ribbon of graphite. The other side is intended for bonding the ribbon to the metallic core or to the carbon fibers surrounding the metallic core. As the graphite ribbon leaves the compression rollers bonded to the adhesive strip, the protective paper or plastic is stripped away, exposing the adhesive on the outside surface of the laminated ribbon. Alternatively, an adhesive coating permits the laminated ribbon to the reinforcing fibers of the core.

Fibrous strands are then threaded into the protrusion device in which they are laid on the adhesive matrix and become attached to the ribbon. The fiber reinforced laminated ribbon, which still has the exposed adhesive on the surface, is fed at a critical angle through a tapered, cone-shaped circular die having a specific geometry suitable for curling the fiber and adhesive coated surface inward upon itself. Therefore, the curled ribbon will adhere to itself when compressed into the final protrusion die, forming a finished fiber, metallic wire,. flattened metallic wire or metallic foil reinforced composite strand of expanded graphite flake having suitable tensile strength, flexibility, and toughness to permit braiding, weaving and other processing which makes it commercially useful wherever a dry, lubricous, strong, flexible material is desirable.

The resulting yarn are wrapped around a spool. The spools of yarn are then placed on creels. A creel is a device that holds a spool of the material from which it feeds the loom. The creel is designed to continually adjust and yield a constant tension on the product being fed into the loom. Yarn from the spools located on the creel are fed into a loom. The loom weaves a sheet having a width from between 12 to 120 inches.

After the strands are woven together, they are compressed together to form homogeneous gasket sheets. Such sheets are flexible, resilient and strong which makes them commercially useful for applications where a dry, lubricous, strong, flexible product that can withstand high temperatures is needed.

The cloth is compressed on a nip roll or in a hydraulic or other suitable press to achieve the desired homogeneous density. The compressed cloth may have additional release agents such as graphite powder, talcum or other such release agents.

Because the invented sheets are made without using a rubber binder, gaskets cut from the invented sheets may often be stored for more twenty (20) years and still remain as supple as when first cut. Also, because the invented sheets may contain fiber, unlike existing non-asbestos compressed sheets, they can be compressed to a much higher degree than the gaskets made from existing non-asbestos compressed sheets.

Since the invented sheet is essentially a woven cloth, gaskets made from the invented sheet also have excellent recovery, unlike gaskets made from existing non-asbestos compressed sheets. The invented sheet is cut easily with a razor blade, utility knife, shears or scissors yet is virtually impossible to break. The invented sheet can also be cut very easily with a steel rule die.

After the yarns are pulled from the exit end of the die, they can be dipped in a non-solvent water based latex which will form a skim coating on the surface of the yarn. This produces a smooth surface finish that permits scribe marking of a finished sheet formed from such yarn.

OBJECTS OF THE INVENTION

The principal object of the present invention is to provide an improved method for joining ribbons of graphite onto reinforcing yarns capable of withstanding the rigors of a gasket.

A further object of this invention is to provide a method of making gasket compatible yarns capable of providing service in temperatures ranging from negative 400° Fahrenheit up to 5400° Fahrenheit.

Another object of this invention is to provide a method for encapsulating reinforcing materials such as quartz fibers, INCONEL™ (alloy #600) wire, stainless steel wire, stainless steel fiber, carbon fiber, graphite fiber, metallic foils and/or other high temperature reinforcements in a jacket of vermiculated graphite.

Another object of this invention is to provide a method for preparing gaskets that does not require the user to first cut into a hard surface with considerable effort.

A further object of this invention is to provide a method for preparing gaskets that may be cut easily with a razor blade or utility knife, yet is virtually impossible to break. Furthermore, the sheets of the present invention may be cut easily with steel rule dies.

Another object of this invention is to provide a method and apparatus for preparing gaskets that may be cut easily with steel rule dies.

BRIEF DESCRIPTION OF THE DRAWINGS

The foregoing and other objects will become more readily apparent by referring to the following detailed description and the appended drawings in which.

DETAILED DESCRIPTION

Figure 1:
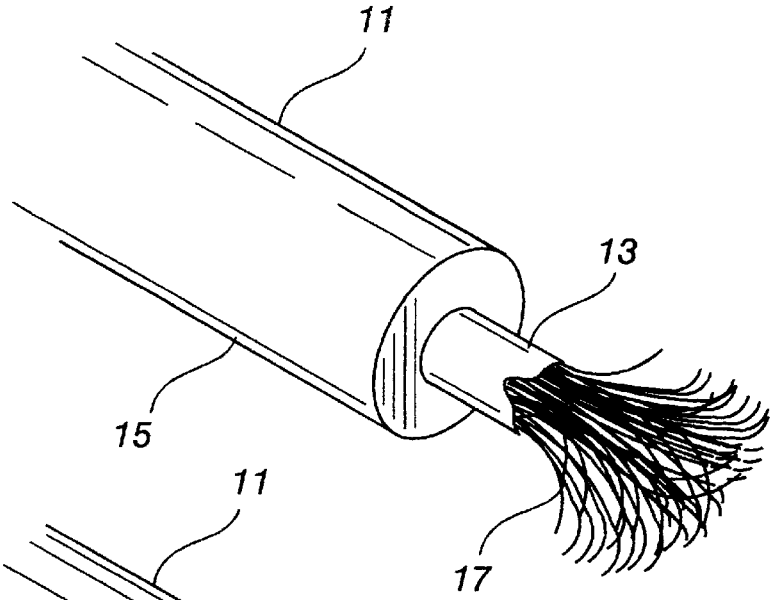
Fig.1 Prior Art
FIG. 1 is an isometric view of a prior art vermiculated graphite jacket substantially encapsulating a core of carbon fibers.

FIG. 1 shows a prior art non-asbestos yarn 1 according to the teaching of U.S. Patent No. to Crosier. A vermiculated graphite jacket 5 covers a plurality of carbon-fibers 7. The jacket 5 is secured to the carbon fibers 7 by a layer of adhesive film 3.

Figure 3:
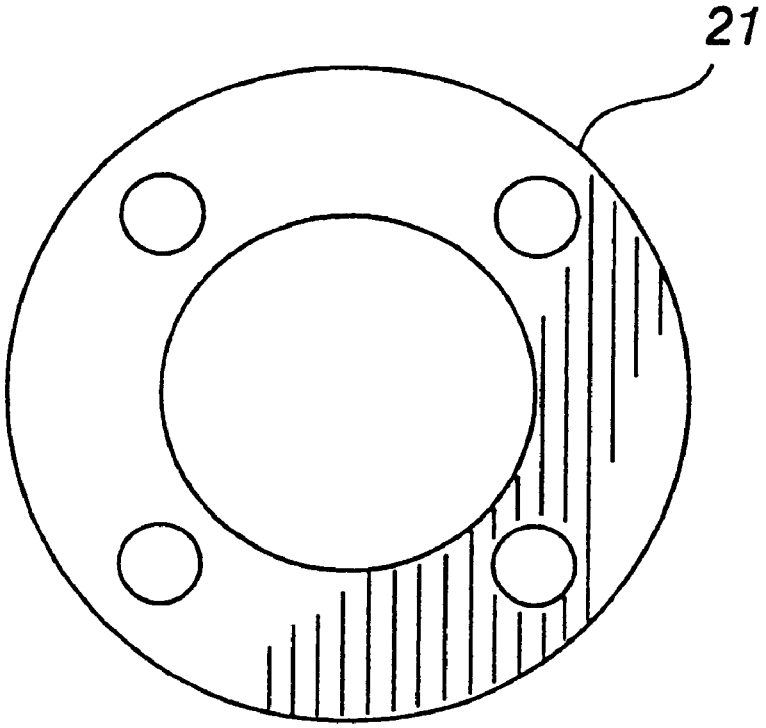
FIG. 3 is a top view of a typical gasket that may formed from the strand of FIG. 4.
Figure 4:
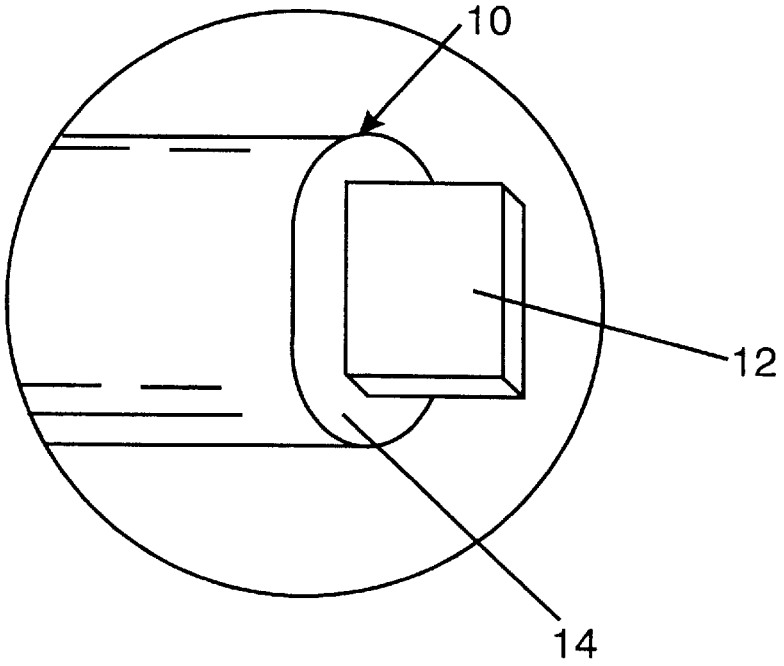
FIG. 4 is an isometric view of another preferred embodiment of the invention showing a vermiculated graphite jacket substantially encapsulating a flattened metallic wire core.

FIG. 3 represents just one of the many kinds of gaskets that may be formed with the yarn of FIG. 4. The shape of the gasket is simply spliced out of the invention after being woven and compressed.

FIG. 4 shows a preferred embodiment of the present invention. The yarn 10 has a core 12 made from a reinforcing metallic material which is encapsulated in a vermiculated graphite jacket 14. Preferably, the core is INCONEL™ nickel alloy or stainless steel. However, any other metal having sufficient tensile strength and specific chemical or temperature resistant properties suitable for reinforcement, quartz fiber, stainless steel fiber or carbon/graphite fiber can be substituted.

Preferably, the jacket 14 is made from either an expanded graphite flake or a graphite foil having suitable tensile strength, flexibility and toughness. Encapsulating the metallic core 12 in a vermiculated graphite jacket 14 obviates the need for rubber binders, additives, curatives and fillers, some of which carbonize in the absence of oxygen at elevated temperatures. The absence of rubber binders, additives, curatives and fillers has no effect on the overall integrity of the yarns because the vermiculated graphite jacket attains the beneficial properties of the rubber binding without its drawbacks.

Thus, sheets 51 made from the invented yarns can be used to seal 4500 psi steam at temperatures in excess of 1200° Fahrenheit. In contrast, existing compressed sheets utilizing rubber binders, additives, curatives and fillers have upper operating limits for sealing steam below 2000 psi and at temperatures below 700° Fahrenheit. Furthermore, those sheets can be formed into products, such as gaskets, that can be exposed to very harsh chemicals, such as solvents, liquid petroleum gases, hydrogen gas and virtually all volatile organic chemicals at most common temperatures and concentrations.

The vermiculated graphite jacketed cores are preferably wire, flattened wire or foil forms that combine high tensile strength and high corrosion resistance and that operate at temperatures up to 1800° Fahrenheit. The invented non-asbestos sheets thereby provide long service life and low maintenance costs.

As shown in FIG. 4, the core 12 is a metallic foil or a flattened metallic wire. Example of suitable metallic foils are INCONEL™ (alloy #600) foil and stainless steel foil. Examples of suitable flattened metallic wires are INCONEL™ (alloy #600) wire and stainless steel wire which are flattened between rollers.

With either the metallic foil or the flattened metallic wire, the core has a substantially rectangular cross-section. Preferably, the core 12 has a thickness of between 0.001 and 0.005 inches and a width of between 0.005 and 0.2 inches. It has been found that a core having a thickness of 0.003 inches and a width of 0.06 inches is particularly suitable.

A suitable adhesive coating (not shown) can also be provided to secure the jacket to the metallic core. Even though the adhesive coating carbonizes at high operating temperatures, the yarns suffer no significant weight or volume loss effect and the sheeting composed from such yarn remain suitable for the services intended. If desired, the adhesive coating may be removed from the yarn by a process of baking the yarn is an industrial oven or a vacuum oven.

Figure 6:
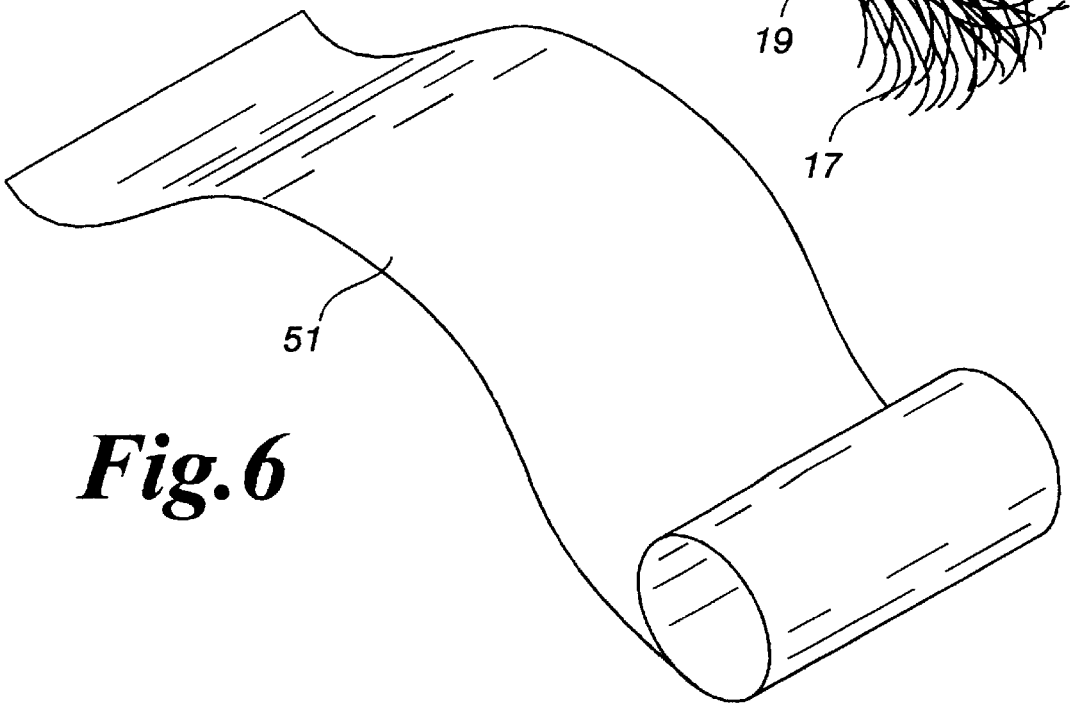
FIG. 6 is an isometric view of the compressed sheet of FIG. 5.
Figure 5:
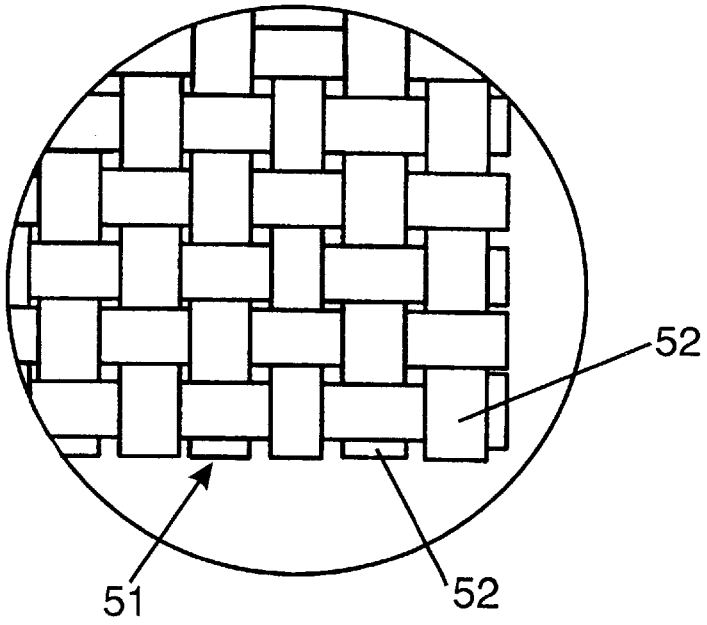
FIG. 5 is a top view of a woven graphite sheet according to the invention after both the weaving and compression stages.

FIG. 6 illustrates a compressed sheet 51 woven from the generally flattened yarn 52. FIG. 5 shows a close-up top view of the compressed sheet 51 of FIG. 6.

Figure 7:
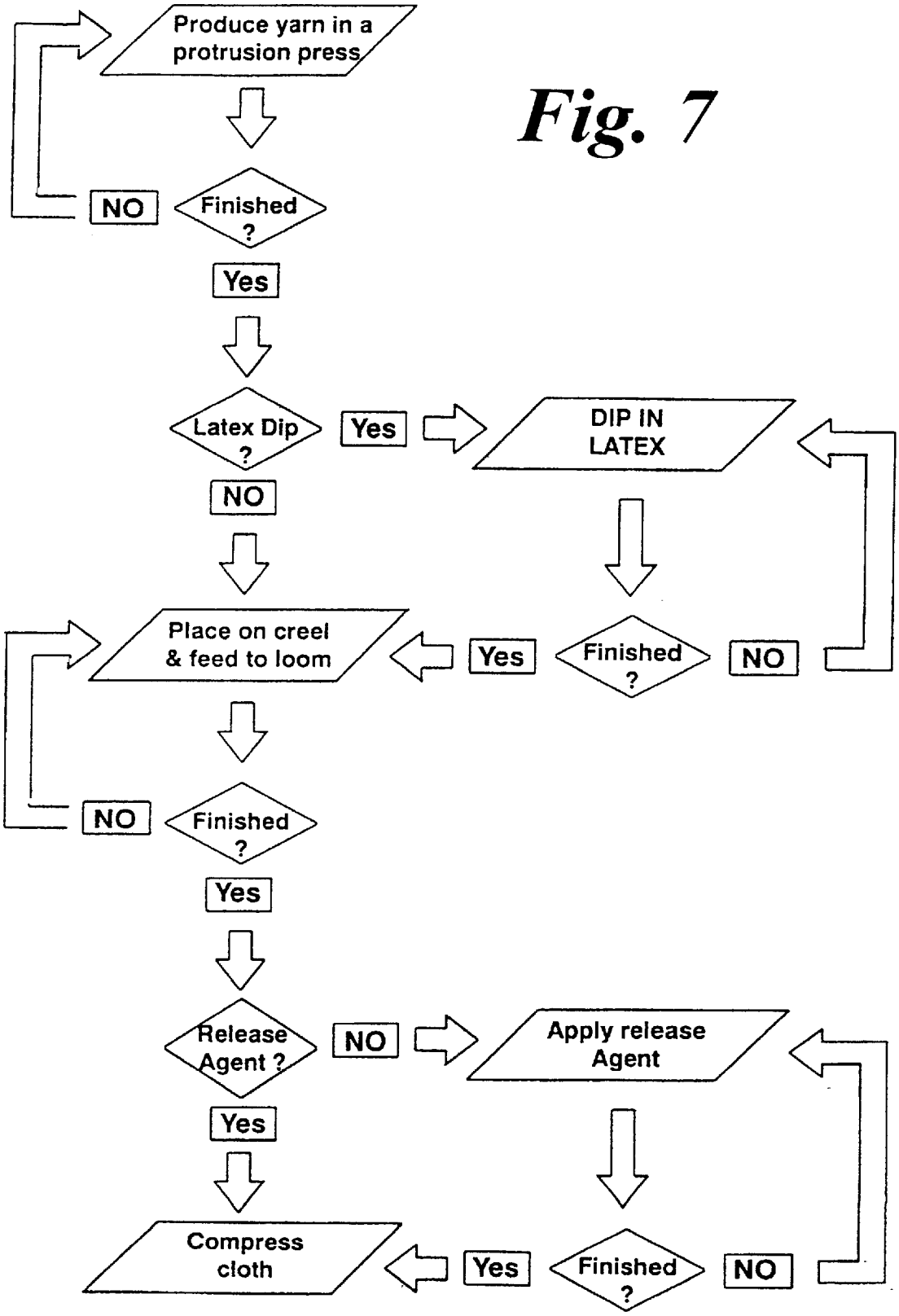
FIG. 7 is a flow chart of the method of manufacturing the invented sheets.

FIG. 7 illustrates the flow chart showing the invented method of making a composite yarn, without using rubber binders, additives, curatives and fillers, useful in the manufacture of non-asbestos gasketing cloth. The basic method for making a composite yarn and compressed sheets from those yarn is disclosed in U.S. Pat. No. 5,683,778 to Crosier which is expressly incorporated herein by reference.

In a preferred embodiment, the strands are a simple, inexpensive yarn made by slitting a roll of expanded graphite flake foil sheet into ribbons having suitable widths for their ultimate purpose. The ribbon is fed into a "protrusion" device which is a combination extrusion/pultrusion die.

A plastic film can then be added to the graphite ribbon. For example, the graphite ribbon is fed through a compression roller with a ribbon of two-sided, adhesive, thin plastic film. One side of the ribbon is bonded to the ribbon of graphite. The other side is intended for bonding the ribbon to the metallic core or to the carbon fibers surrounding the metallic core. As the graphite ribbon leaves the compression rollers bonded to the adhesive strip, the protective paper or plastic is stripped away, exposing the adhesive on the outside surface of the laminated ribbon. Alternatively, an adhesive coating permits the laminated ribbon to the reinforcing fibers of the core.

Fibrous strands are then threaded into the protrusion device in which they are laid on the adhesive matrix and become attached to the ribbon. The fiber reinforced laminated ribbon, which still has the exposed adhesive on the surface, is fed at a critical angle through a tapered, cone-shaped circular die having a specific geometry suitable for curling the fiber and adhesive coated surface inward upon itself. Therefore, the curled ribbon will adhere to itself when compressed into the final protrusion die, forming a finished fiber, metallic wire, flattened metallic wire or metallic foil reinforced composite strand of expanded graphite flake having suitable tensile strength, flexibility, and toughness to permit braiding, weaving and other processing which makes it commercially useful wherever a dry, lubricous, strong, flexible material is desirable.

The resulting yarn are wrapped around a spool. The spools of yarn are then placed on creels. A creel is a device that holds a spool of the material from which it feeds the loom. The creel is designed to continually adjust and yield a constant tension on the product being fed into the loom. Yarn from the spools located on the creel are fed into a loom. The loom weaves a sheet having a width from between 12 to 120 inches.

After the strands are woven together, they are compressed together to form homogeneous gasket sheets. Such sheets are flexible, resilient and strong which makes them commercially useful for applications where a dry, lubricous, strong, flexible product that can withstand high temperatures is needed.

The cloth is compressed on a nip roll or in a hydraulic or other suitable press to achieve the desired homogeneous density. The compressed cloth may have additional release agents such as graphite powder, talcum or other such release agents.

Because the invented sheets are made without using a rubber binder, gaskets cut from the invented sheets may often be stored for more twenty (20) years and still remain as supple as when first cut. Also, because the invented sheets may contain fiber, unlike existing non-asbestos compressed sheets, they can be compressed to a much higher degree than the gaskets made from existing non-asbestos compressed sheets.

Since the invented sheet is essentially a woven cloth, gaskets made from the invented sheet also have excellent recovery, unlike gaskets made from existing non-asbestos compressed sheets. The invented sheet is cut easily with a razor blade, utility knife, shears or scissors yet is virtually impossible to break. The invented sheet can also be cut very easily with a steel rule die.

After the yarns are pulled from the exit end of the die, they can be dipped in a non-solvent water based latex which will form a skim coating on the surface of the yarn. This produces a smooth surface finish that permits scribe marking of a finished sheet formed from such yarn.

Figure 2:
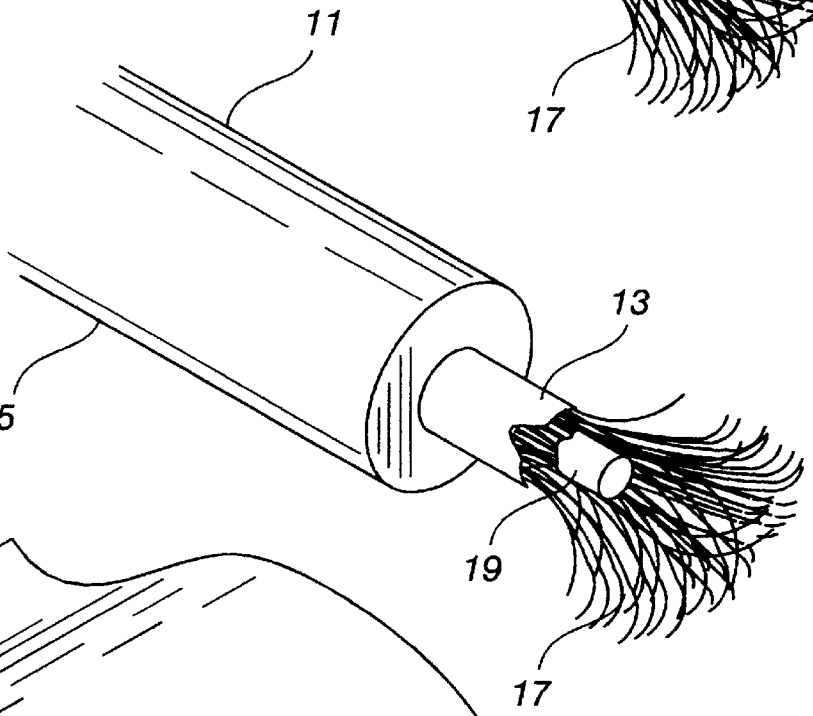
FIG. 2 is an isometric view of one preferred embodiment of the invention showing a vermiculated graphite jacket substantially encapsulating a metallic wire core shrouded by a plurality of carbon fibers.

FIG. 2 shows another preferred embodiment of a yarn 11 for use in manufacturing a high temperature sheet gasketing material the present invention. Examples of suitable metallic wire include INCONEL™ (alloy #600) wire and stainless steel wire.

The yarn 11 has a metallic wire core 19 shrouded by a plurality of carbon fibers 17. A vermiculated graphite jacket 15 having a tensile strength of 600,000 psi encapsulates the core 19 and the plurality of carbon fibers 17 shrouding the core 19. The carbon fibers 17 shrouding the wire core 19 prevent the wire core 19 from cutting through the graphite jacket 15. This yarn is also suitable for braiding to form a high temperature-high pressure valve packing.

The metallic wire core 19 has either a circular or an oval shaped cross-section. Preferably, the diameter of the metallic wire core is between 0.002 and 0.01 inches. It has been found that a diameter of between 0.004 and 0.005 inches is particularly suitable.

An adhesive coating 13 can be used to secure the jacket 15 to the carbon fibers 17 shrouding the core 19. Preferably, the adhesive coating 13 initially substantially encapsulates the plurality of carbon fibers 17 and the metallic wire core 19. A plastic film (not shown) may be used in conjunction with the adhesive coating 13. A polyester film having a thickness of 0.00025 inches has been found to be particularly suitable.

SUMMARY OF THE ACHIEVEMENT OF THE OBJECTS OF THE INVENTION

From the foregoing, it is readily apparent that I have invented an improved method for joining ribbons of graphite onto reinforcing yarns capable to withstand the rigors of a gasket, and a gasket which is capable of providing service in temperatures from −400° F. up to 5400° F.

Furthermore, I have invented an improved method for encapsulating reinforcing materials such as quartz fibers, INCONEL™ (alloy #600) wire, stainless steel wire, stainless steel fiber, carbon fiber, graphite fiber, metallic foils and/or other high temperature reinforcements in a jacket of vermiculated graphite, and an improved method for preparing gaskets that no longer require the user to first cut into a hard surface with considerable effort, and a high temperature sheet which is cut easily with a razor blade or utility knife, yet is virtually impossible to break, and may be cut easily with steel rule dies.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A yarn for use in manufacturing a high temperature sheet gasketing material comprising:

an elongated core comprising a metallic foil reinforcing material; and;

a vermiculated graphite foil jacket substantially encapsulating said core.

2. The yarn of claim 1 further comprising an adhesive film substantially surrounding said core for initially securing said jacket to said core.

3. The yarn of claim 1 wherein said core has a thickness of between 0.001 and 0.005 inches and a width of between 0.005 and 0.2 inches.

4. The yarn of claim 1 wherein said core has a thickness of 0.003 inches and a width of 0.06 inches.

5. The yarn of claim 1 wherein said vermiculated graphite foil jacket is generally tubular in shape and has a generally oval cross-section.

6. The yarn of claim 1 further comprising a plurality of carbon fibers substantially shrouding said metallic wire foil.

7. The yarn of claim 6 further comprising an adhesive coating substantially encapsulating said plurality of carbon fibers and said metallic core.

8. The yarn of claim 7 further comprising a plastic film substantially encapsulating said adhesive coating.

9. The yarn of claim 8 wherein said plastic film is a polyester film having a thickness of 0.00025 inches.

10. A high temperature non-asbestos non-clay non-rubber woven fiber yarn comprising;

an elongated core having a generally rectangular or oval cross-section;

said core consisting of a reinforcing material selected from the following group metallic foil, quartz fiber, flattened metallic wire, INCONEL™ (alloy #600) wire, INCONEL (alloy #600) foil, stainless steel wire, stainless steel foil, stainless steel fibers, carbon fibers and graphite fibers;

a vermiculated graphite jacket substantially encapsulating said core; and an adhesive coating for securing said jacket to said core, wherein said layer of adhesive film has a first adhesive side and a second adhesive side, and said first adhesive side contacts said core and said second adhesive side of said laver of adhesive film contacts said jacket.

* * * * *